US005727699A

United States Patent [19]

Gilcrease

[11] Patent Number: 5,727,699

[45] Date of Patent: Mar. 17, 1998

[54] SPOOL HOLDER

[76] Inventor: Ann M. Gilcrease, 611 Hidden Oak Ct., Lewisville, Tex. 75067-8630

[21] Appl. No.: 503,842

[22] Filed: Jul. 18, 1995

[51] Int. Cl.[6] ..... A47F 7/00

[52] U.S. Cl. ..... 211/113; 211/118; 211/49.1; 211/59.1

[58] Field of Search ..... 211/113, 118, 211/49.1, 59.1; 248/339, 340; 242/570, 588, 588.2, 588.1; D6/521, 523, 520

[56] References Cited

U.S. PATENT DOCUMENTS

| | | | |
|---|---|---|---|
| D. 367,388 | 2/1996 | Essman | D6/521 X |
| 603,940 | 5/1898 | Carkin | 248/340 |
| 1,464,160 | 8/1923 | Weyel | 248/340 |
| 1,700,265 | 1/1929 | Kissam | 211/59.1 X |
| 2,984,434 | 5/1961 | Train | 211/113 X |
| 3,378,183 | 4/1968 | Ferrer | 211/49.1 X |
| 4,654,991 | 4/1987 | Jones | 211/118 X |
| 5,040,679 | 8/1991 | Rehmann | 211/59.1 X |

*Primary Examiner*—Robert W. Gibson, Jr.
*Attorney, Agent, or Firm*—L. Dan Tucker

[57] ABSTRACT

A spool holder for storing and dispensing ribbon and other material contained on spools. The spool holder comprises a vertical rod having a hook adjacent its upper portion for hanging on a rod in a closet or other storage area. A pedestal is adjacent the lower portion of the vertical rod to support the spools on the spool holder. Holding members are adjacent the upper portion of the vertical rod below the hook. These holding members can store and provide easy accessibility of supplies used with the spooled material, for example, tape, scissors, bows and glue. A cooperative fastening means removably couples the upper portion and the lower portion of the vertical rod. In the uncoupled configuration, the spools of ribbon can be received onto or removed from the vertical rod. When coupled, the pedestal of the lower portion of the vertical rod supports the spools on the vertical rod.

14 Claims, 3 Drawing Sheets

SPOOL HOLDER

FIELD OF THE INVENTION

The present invention pertains to apparatus and methods for storing ribbon and other material contained on spools neatly and visibly and for multiple dispensing of the spooled material with easy accessibility.

BACKGROUND OF THE INVENTION

Decorative ribbon and material are customarily the finishing touch on wrapped gifts and presents and on decorative gift bags. The decorative ribbon and material have seasonal themes such as Christmas, Thanksgiving and Easter, and for particular occasions such as birthdays, graduations and weddings. Much of the decorative ribbon and material is multi-purpose, for example, seasonal themes, and is used in arts and crafts for home and other decorative purposes. The ribbon and material is usually purchased on spools which have a center opening for inserting a dowel or other rod for dispensing the material.

Conventional storage of the spooled material includes boxes or cartons. While some of the storage containers may be composed of transparent or translucent material for visibility of the contents, many are not. In addition, the storage boxes are usually tucked away on a shelf or the floor of a closet or other storage area. Many times, other items are stored on top and in front of the boxes of spooled material. Thus, even if a box is translucent, it must be removed from the storage area in order for its contents to be visible. Rather than expend the effort to access the storage containers to determine if an appropriate seasonal or occasional theme ribbon is available, the user will more often purchase new ribbon with a gift purchase or with other project supplies. This increases the time required to make a purchase, and, in addition, the stored ribbon and material is not used and consequently is wasted. In the alternative, the user may believe an appropriate ribbon is stored, only to realize when he/she is ready to wrap a present or embark on an arts and crafts project, that a suitable theme is not available.

The supplies used with spooled ribbon and material, such as tape, glue, scissors, bows, decorative bags, wrapping paper and cards are usually stored separately and away from the spooled material. This is inconvenient since the items have to be gathered from the various locations to accomplish one project. In addition, the items may be misplaced and not readily available when needed.

Conventional dispensing of the spooled material is usually accomplished by holding the loose end of the material and pulling the required amount from the spool. Many times, the spool, or a dowel which may contain the spool, rolls uncontrollably. An excess amount of material is dispensed and must be rewound onto the spool. This problem is exacerbated when multiple ribbons are used simultaneously. In addition, the ribbons may become tangled and knotted as the spools intertwine.

SUMMARY OF THE INVENTION

In accordance with the present invention, a spool holder comprises a vertical rod having an upper portion and a lower portion. A hook is adjacent the upper portion of the vertical rod and is for hanging the spool holder on a rod in a closet or other storage area. A support pedestal is adjacent the lower portion of the vertical rod. The support pedestal supports the spools of ribbon on the vertical rod. The pedestal can be positioned on a substantially flat surface to support the spool holder in a vertical position when the spool holder is not hung. In addition, the support pedestal can prevent the spool holder from rolling when the spool holder is in a substantially horizontal position for dispensing the spooled material.

The upper portion and the lower portion of the vertical rod or the rod and pedestal are removably coupled by a cooperative fastening means. The fastening means can be a sleeve lock and key configuration with the sleeve lock adjacent the upper portion and the key adjacent the lower portion of the vertical rod. The key is aligned and inserted into the sleeve lock, then rotated into a locked position for containing the spools positioned on the vertical rod. The fastening means can also be threaded male and female members to removably attach the rod segments together or to removably attach the rod to the support pedestal. The spools of ribbon can be slipped or threaded onto and removed from the vertical rod when the upper and lower rod portions or the rod and support pedestal are disengaged and coupled, respectively.

A plurality of holding members can be adjacent the upper portion of the vertical rod below the hook of the spool holder. Each of the holding members comprise a horizontal rod which extends radially from the vertical rod and an upwardly angled rod which extends from the horizontal rod. The holding members can be spaced equally around the vertical rod. Supplies used with the spooled material such a scissors, tape, bows and bags, can be hung from the holding members for storage and easy accessibility.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE PREFERRED EMBODIMENT

Figure 1:
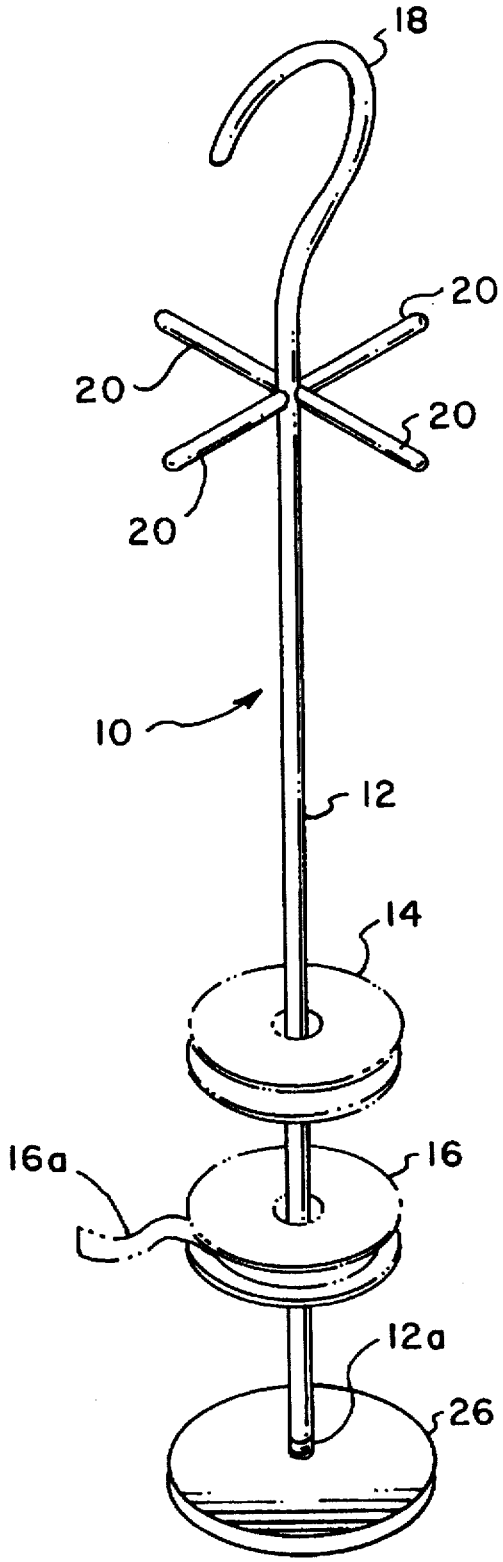
FIG. 1 provides a perspective view of a spool holder of my invention.

Referring to FIG. 1, a spool holder 10 for storing and dispensing spools of ribbon and material includes a vertical rod 12 with hook 18 adjacent the upper portion of such vertical rod. Spools 14 and 16 are shown in phantom outline to illustrate how they are retained on vertical rod 12. Vertical rod 12 has a diameter that is slightly less than the diameter of standard ribbon spools 14 and 16 whereby ribbon can be dispensed by pulling ribbon end 16*a*, causing the spool to rotate about rod 12 to unwind ribbon from the spool. Support pedestal 26 is adjacent the lower end of vertical rod 12. Support pedestal 26 supports ribbon spools when rod 12 is maintained in the vertical position. As will be evident from FIG. 1, numerous spools of ribbon or other material can be supported on rod 12 when it is maintained in the vertical position. A plurality of holding members 20 can be disposed adjacent the upper end of vertical rod 12 proximate to hook 18. Holding members 20 are quite useful to hang such items as scissors, tied bows and other supplies on. Preferably the holding members are equi-spaced radically around rod 12.

A cooperative fastening means can be incorporated in the lower end of vertical rod 12 to allow the removable attachment of rod 12 from support pedestal 26. In the embodiment shown in FIG. 1, the lower end of rod 12 is threaded in the area designated as **12*a* and is screwed into mating threads in an aperture in the center of support pedestal 26. It will be appreciated that support pedestal 26 is shown as a circular design in FIG. 1. It will be appreciated that any number of various shapes can be utilized as support pedestal 26 so long as pedestal 26** is larger than the aperture in the center of the spools to be supported.

Figure 2:
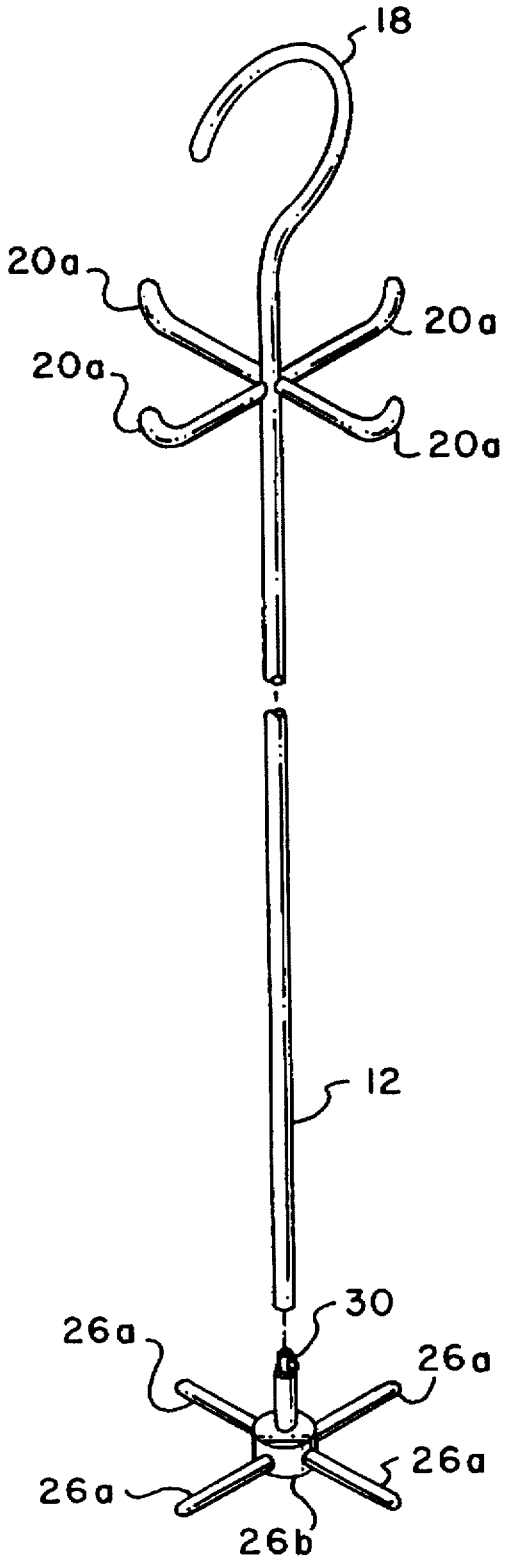
FIG. 2 provides a perspective view of another embodiment of my invention.
Figure 2A:
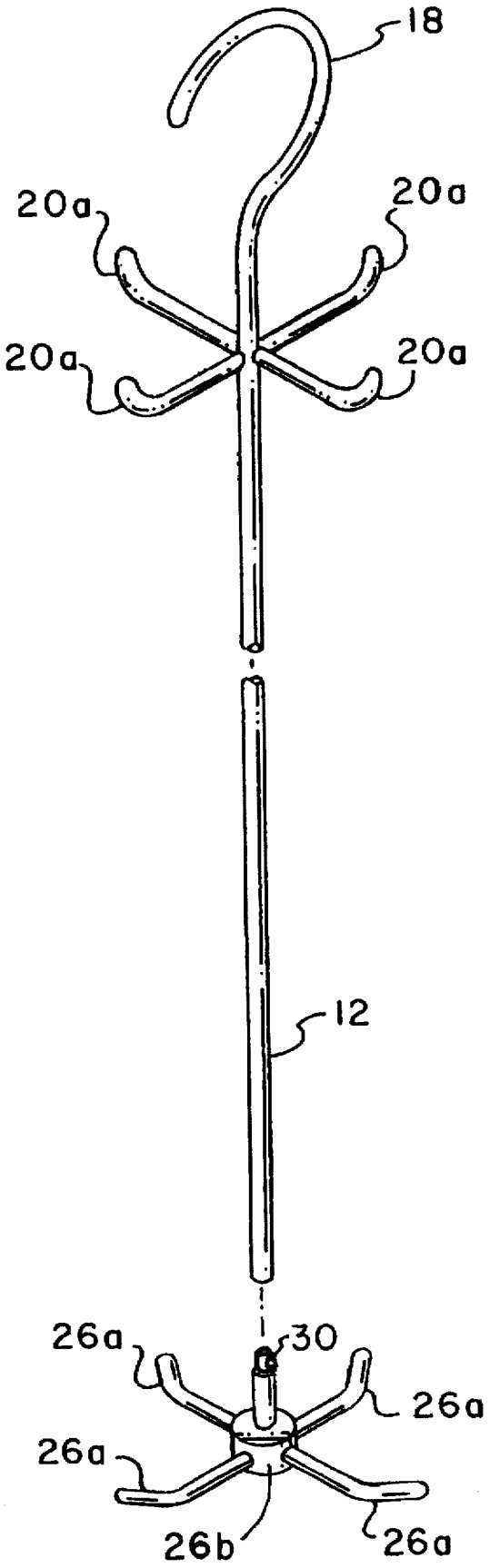
FIG. 2A provides a perspective view of another embodiment of my invention.

By referring to FIG. 2, other preferred embodiments of the instant invention are shown. As shown in FIG. 2, holding members **20*a* are horizontally extending rods that have upturned distal portions to facilitate hanging various items on such holding members. These upwardly angled or extending distal portions will reduce the tendency of items to slip off the ends of the holding members. In FIG. 2, the support pedestal is formed by a combination of a central hub 26 with a plurality outwardly extending rods 26*a* to support spools that are retained by rod 12. In FIG. 2, instead of merely screwing the lower end of rod 12 into the support pedestal base, a unique cooperative fastening means is illustrated. It will be appreciated that the outwardly extending rods forming the support pedestal can be as few as two rods. Preferably the rods forming the support pedestal shall be equi-spaced radially around the lower end of rod 12. It will also be appreciated that the rods forming the support pedestal could be angled to extend downwardly and outwardly from the lower end of rod 12**.

As shown in FIG. 2, the cooperative fastening means for attaching the support pedestal portion to the rod 12 is formed by a locking key 30 that extends upwardly from the pedestal portion. This locking key is adapted to fit within a sleeve lock apparatus that is more fully shown in FIG. 3.

Figure 3:
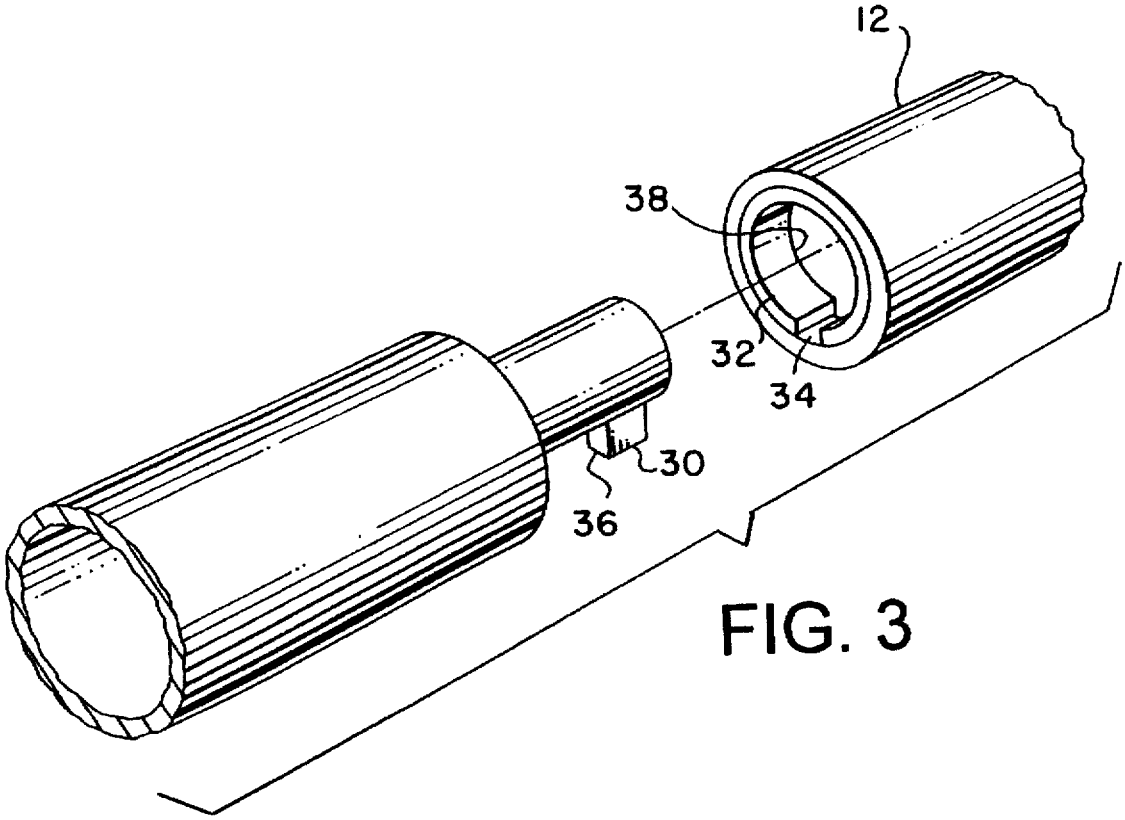
FIG. 3 provides an exploded view of a preferred cooperative fastening means to engagingly couple an upper and lower portion of the spool holder.

By turning to FIG. 3, the cooperative fastening means is shown in exploded view. Rod 12 is normally fabricated from a tubular extruded material. By inserting a split sleeve lock 32 into the inner diameter of rod 12, such split sleeve lock can be permanently held in place by gluing, heat sealing and the like. Split portion 34 of split sleeve lock 32 is sized to receive locking key 30 carried by the pedestal portion as it is inserted into the split sleeve lock. Once key 30 is inserted into the split sleeve lock 32, the lower support pedestal portion that carries key 30 can be rotated whereby key face 36 is supported by shoulder 38, the pedestal will thus be removably attached to rod 12 in the device shown in FIG. 2. When it is desired to remove the pedestal from rod 12 in the embodiment shown in FIG. 2, the lower support pedestal need merely be rotated to a location wherein key 30 aligns with split zone 34 and the support pedestal can be removed from rod 12 by pulling the pedestal away from rod 12. It will be appreciated that various other ways of removeably attaching the support pedestal from rod 12 can be utilized. For example, friction fitting male and female members as well as threaded male and female members in interrupted portions of rod 12 can also be utilized.

From the foregoing, it will be appreciated that any desired number of spools of ribbon or other material can be assembled onto rod 12 and supported by the support pedestal.

In use, ribbon or other material can be dispensed from the spools by merely pulling the ribbon end while the rod is held in the vertical position to dispense ribbon from the spools. In another preferred embodiment however, the entire rod assembly can be removed by disengaging the hook 18 from the supporting structure and the rod assembly can be placed in a horizontal position on a table or the floor. By placing the rod in the horizontal position, the various spools that are threaded onto rod 12 are supported above the floor or table that the rod assembly is laid on by virtue of the engagement of the support pedestal and the holding members 20 and **20*a* with the floor or table. By sizing the support pedestal and the holding members where they are slightly longer than the radius of standard ribbon spools, the spools will be held above the floor or table that supports the horizontal rod 12. This facilitates the use of the horizontal rod as a dispenser for ribbon and other materials that are stored on the spools contained on rod 12**.

It will be appreciated that the device of this invention can be made from a variety of materials such as plastic, metal, wood and the like. It will also be appreciated that the device of this invention can be disassembled for easy packaging and shipment by removing the support pedestal and upper holding members. In some instances, it may be desirable from a packaging and marketing standpoint to have rod 12 disassembled into two or more pieces that the user can attach together by friction fitting, screwing or gluing.

It will be appreciated that various changes and modifications may be made in the structure illustrated in the Figures but without departing from the spirit and scope of my invention.

I claim:

1. A spool holder comprising:

a vertical rod having an upper portion and a lower portion to receive and hold spools;

a cooperative fastening means incorporated in said vertical rod between said upper portion and said support pedestal for removably engaging said upper portion with said support pedestal;

a hook adjacent said upper portion of said vertical rod for suspending said spool holder; and a support pedestal adjacent said lower portion of said vertical rod to support said spools.

2. A spool holder, as recited in claim 1, further comprising:

a plurality of holding members adjacent said upper portion of said vertical rod proximate to said hook.

3. A spool holder, as recited in claim 2, wherein each of said plurality of holding members comprises a horizontal rod adjacent said upper portion of said vertical rod and an angled rod extending from said horizontal rod at the distal end.

4. A spool holder, as recited in claim 2, wherein said plurality of holding members are equi-spaced radially around said vertical rod.

5. A spool holder, as recited in claim 3, wherein said plurality of holding members are equi-spaced radially around said vertical rod.

6. A spool holder, as recited in claim 1, further comprising:

a first holding member and a second holding member, said first and second holding members adjacent said upper portion of said vertical rod proximate to said hook.

7. A spool holder, as recited in claim 6, wherein each of said first and second holding members comprises a horizontal rod adjacent said upper portion of said vertical rod and an angled rod extending from said horizontal rod.

8. A spool holder, as recited in claim 6, wherein said first holding member and said second holding member are equi-spaced radially around said vertical rod.

9. A spool holder, as recited in claim 7, wherein said first holding member and said second holding member are equi-spaced radially around said vertical rod.

10. A spool holder, as recited in claim 1, wherein said pedestal comprises a plurality of horizontal support members extending radially from said lower portion of said vertical rod.

11. A spool holder, as recited in claim 1, wherein said pedestal comprises a plurality of angled support members extending downwardly and outwardly from said lower portion of said vertical rod.

12. A spool holder, as recited in claim 10, wherein said plurality of horizontal support members are equi-spaced radially around said vertical rod.

13. A spool holder, as recited in claim 12, further comprising, a first holding member and a second holding member, said first and second holding members adjacent said upper portion of said vertical rod proximate to said hook.

14. A spool holder, as recited in claim 13, wherein each of said first and second holding members comprises a horizontal rod adjacent said upper portion of said vertical rod and an angled rod extending from said horizontal rod.

* * * * *